US011549475B2

(12) United States Patent
Jin

(10) Patent No.: US 11,549,475 B2
(45) Date of Patent: Jan. 10, 2023

(54) FUEL SUPPLY NOZZLE UNIT HAVING SEALING STRUCTURE

(71) Applicant: DOOSAN ENERBILITY CO., LTD, Changwon-si (KR)

(72) Inventor: Heon Seop Jin, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 40 days.

(21) Appl. No.: 16/789,432

(22) Filed: Feb. 13, 2020

(65) Prior Publication Data

US 2020/0182211 A1 Jun. 11, 2020

Related U.S. Application Data

(62) Division of application No. 15/179,474, filed on Jun. 10, 2016, now Pat. No. 10,605,215.

(30) Foreign Application Priority Data

Jun. 22, 2015 (KR) ..... 10-2015-0088543

(51) Int. Cl.

| | |
|---|---|
| ***F02M 61/18*** | (2006.01) |
| ***F23R 3/28*** | (2006.01) |
| ***F23D 11/38*** | (2006.01) |
| ***F23D 14/48*** | (2006.01) |
| ***F02M 61/16*** | (2006.01) |
| ***F02M 61/20*** | (2006.01) |

(52) U.S. Cl.

CPC ..... *F02M 61/1853* (2013.01); *F02M 61/168* (2013.01); *F02M 61/1866* (2013.01); *F02M 61/20* (2013.01); *F23D 11/38* (2013.01); *F23D 14/48* (2013.01); *F23R 3/283* (2013.01); *F23R 2900/00017* (2013.01)

(58) Field of Classification Search

CPC ..... F02M 61/1853; F02M 61/1866; F02M 61/20; F02M 61/168; F23R 3/283; F23R 2900/00017; F23D 11/38; F23D 14/48

See application file for complete search history.

(56) References Cited

U.S. PATENT DOCUMENTS

| | | | | |
|---|---|---|---|---|
| 2,804,917 A | | 9/1957 | Smith | |
| 2,965,303 A | | 12/1960 | Henrya | |
| 3,121,992 A | * | 2/1964 | Zwicky | F02K 9/68 60/218 |
| 4,712,370 A | * | 12/1987 | MacGee | F01D 21/003 277/345 |
| 5,129,582 A | * | 7/1992 | Rieke | F23L 7/002 431/190 |

(Continued)

FOREIGN PATENT DOCUMENTS

| | | | |
|---|---|---|---|
| JP | S48-25444 | A | 7/1973 |
| JP | H4-227410 | A | 8/1992 |

(Continued)

*Primary Examiner* — Qingzhang Zhou
*Assistant Examiner* — Joel Zhou
(74) *Attorney, Agent, or Firm* — Harvest IP Law LLP

(57) ABSTRACT

A fuel supply nozzle unit includes a fuel supply nozzle, a rear end and an end plate. The fuel supply nozzle includes a front end that has a plurality of fuel supply holes. The rear end extends from the front end and is formed with a threaded portion on its outer surface. The end plate is connected to the rear end and is formed with a plurality of threaded holes.

7 Claims, 9 Drawing Sheets

(56) References Cited

U.S. PATENT DOCUMENTS

| | | | | |
|---|---|---|---|---|
| 5,228,283 | A | 7/1993 | Sciocchetti | |
| 5,355,670 | A * | 10/1994 | Sciocchetti | F23D 17/002 60/742 |
| 5,873,237 | A | 2/1999 | Medla | |
| 6,378,787 | B1 | 4/2002 | Buchi et al. | |
| 6,705,087 | B1 | 3/2004 | Ohri et al. | |
| 7,531,048 | B2 * | 5/2009 | Woodcock | B08B 9/00 134/22.18 |
| 8,505,311 | B2 * | 8/2013 | DesChamps | F02C 7/22 60/796 |
| 2005/0005610 | A1 | 1/2005 | Belsom et al. | |
| 2006/0026966 | A1 | 2/2006 | Moraes | |
| 2007/0033940 | A1 | 2/2007 | Duverneuil | |
| 2011/0005230 | A1 | 1/2011 | Bailey et al. | |
| 2011/0083442 | A1 | 4/2011 | Khan et al. | |
| 2011/0088409 | A1 * | 4/2011 | Carlisle | F23R 3/283 29/700 |
| 2011/0203283 | A1 | 8/2011 | Bottcher et al. | |
| 2012/0096839 | A1 * | 4/2012 | Chang | F01N 13/008 60/276 |
| 2012/0183911 | A1 | 7/2012 | Belsom et al. | |
| 2013/0174558 | A1 | 7/2013 | Stryapunin et al. | |
| 2013/0294864 | A1 | 11/2013 | Bhat et al. | |
| 2014/0026578 | A1 | 1/2014 | Kato et al. | |
| 2014/0241858 | A1 | 8/2014 | Tashiro et al. | |
| 2014/0338339 | A1 | 11/2014 | Westmoreland et al. | |
| 2015/0000283 | A1 | 1/2015 | Ramier et al. | |
| 2015/0089954 | A1 | 4/2015 | Widenhorn et al. | |

FOREIGN PATENT DOCUMENTS

| | | | |
|---|---|---|---|
| JP | H04227410 | A | 8/1992 |
| JP | H10205757 | A | 8/1998 |
| JP | H11159757 | A | 6/1999 |
| JP | 2010-216668 | A | 9/2010 |
| KR | 20-1999-028389 | U | 7/1999 |

* cited by examiner

FUEL SUPPLY NOZZLE UNIT HAVING SEALING STRUCTURE

CROSS-REFERENCE TO RELATED APPLICATIONS

This application is a divisional of U.S. application Ser. No. 15/179,474, filed on Jun. 10, 2016, which claims priority to Korean Patent Application No. 10-2015-0088543 filed on Jun. 22, 2015, the contents of which are incorporated herein in their entirety.

BACKGROUND

The present disclosure relates to a fuel supply nozzle, and more particularly, to a fuel supply nozzle unit, of which a threadedly engaging structure is provided on a plurality of nozzles itself which are provided on a rear end of a combustor of a gas turbine, thereby quickly and easily installing the nozzles and substantially sealing the nozzles.

In general, a turbine generator widely used for a gas turbine power plant drives a turbine by use of a combustion gas produced by burning a fuel with a compressed air.

A combustor for burning the fuel is generally provided with a plurality of nozzles, and the plurality of nozzles are fed with the fuel from a fuel storage, and then eject the fuel of high pressure into the combustor.

In order to fix the nozzles to a rear end of the combustor, according to the conventional method, a rear end of the respective nozzles is additionally provided with a fastening structure capable of connecting the respective nozzles to the rear end of the combustor. (see US Patent Application Publication No. 2014/0241858)

The method has some drawbacks in that additional configuration is required to fix the respective nozzles to the rear end, and thus additional process and costs for manufacturing the fastening structure are needed.

BRIEF SUMMARY

Therefore, the present disclosure has been made in view of the above problems, and an object of the present disclosure is to provide a fuel supply nozzle unit capable of quickly and easily connecting at least one nozzle to a rear end of a combustor, as well as having a sufficient sealing effect.

In order to achieve the above object, there is provided a fuel supply nozzle unit including a fuel supply nozzle having a front end which is provided with a plurality of fuel supply holes, a rear end which extends from the front end, and is formed with a threaded portion on its outer surface, and an end plate which is connected to the rear end, and is formed with a plurality of threaded holes; a fuel supply nozzle case which is provided with a plurality of fuel supply nozzle mounting holes, the respective fuel supply nozzle mounting holes being formed with a threaded surface which is threadedly engaged with the threaded portion; and a washer which is placed on an interface between the end plate and the fuel supply nozzle case, and is provided with a plurality of washer holes corresponding to the plurality of screw holes formed in the end plate.

The washer includes at least one protrusion on an outer peripheral surface thereof.

The fuel supply nozzle unit may further includes a plurality of sealing members which are provided on an interface between an outer surface of the rear end and an inner surface of the plurality of fuel supply nozzle mounting holes formed on the fuel supply nozzle case.

The plurality of sealing members may be a metal spring for forming at least one contact surface.

An inlet of the respective fuel supply nozzle mounting holes and the rear end of the fuel supply nozzle may be provided with a stepped portion.

A metal spring for forming at least one contact surface may be provided on a bottom surface of the stepped portion which is formed at the inlet of the respective fuel supply nozzle mounting holes.

With the above configuration of the fuel supply nozzle unit according to the present disclosure, since the nozzle itself includes a threadedly fastening structure, it is possible to quickly assemble and disassemble the nozzle, without installing additional components. Therefore, as well as quickly carrying out engagement and disengagement of the nozzle, it is possible to reduce a production time and cost of the nozzle components.

DETAILED DESCRIPTION

Figure 1A:
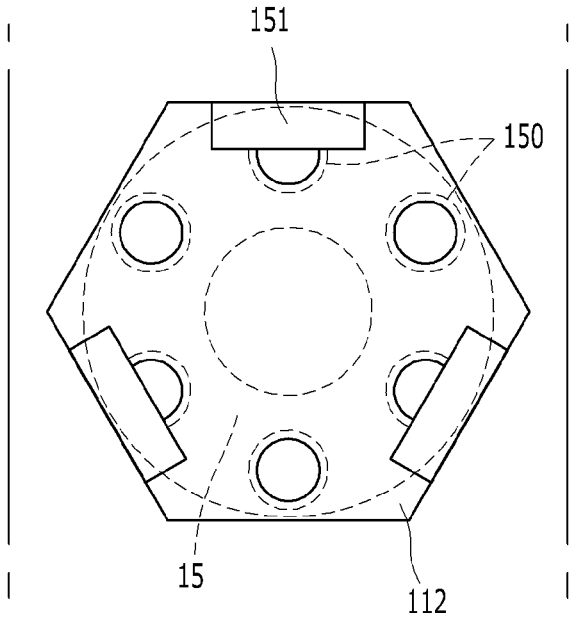
FIG. 1A is a top view illustrating a washer having a protrusion according to one embodiment of the present disclosure.

Hereinafter, embodiments of the present disclosure will be described in detail with reference to the accompanying drawings. In describing the embodiments of the present disclosure, the same reference numerals are used throughout the drawings to refer to the same elements, and redundant description thereof will omitted if necessary.

In addition, the expressions that mean ordinal numbers in the specification, such as "first," "second," "A," "B," "(a)," "(b)," and the like, are used for describing various constituent elements without imposing any limitation to the various constituent elements. The expressions that mean the ordinal numbers are used only for distinguishing among the constituent elements of the same kind. when one element is described as being "connected" or "coupled" to the other element, it should be understood that one element may be directly connected or coupled to the other element, but a third element may be interposed between the two elements. In contrast, when one element is described as being "directly connected" or "directly coupled" to the other element, it should be understood that a third element is not interposed between the two elements.

Figure 2:
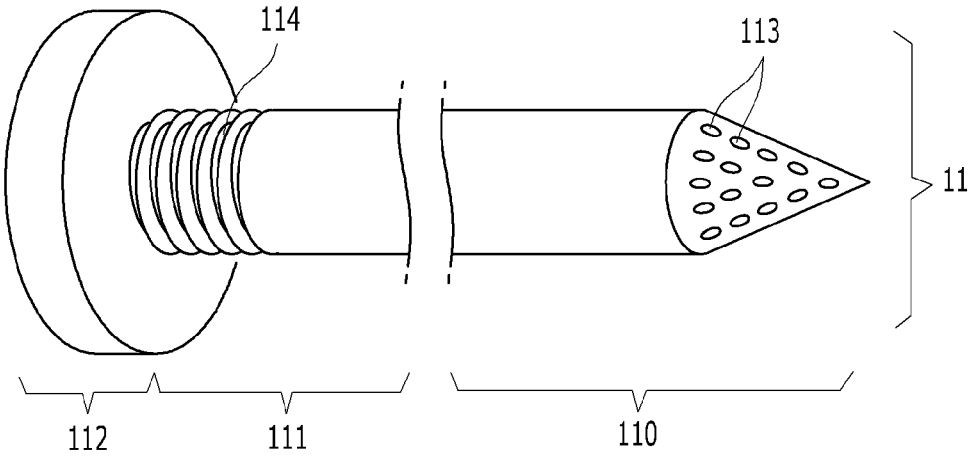
FIG. 2 is a perspective view of a fuel supply nozzle which is provided with a plurality of fuel supply holes according to one embodiment of the present disclosure.

FIG. 2 is a perspective view of a fuel supply nozzle 11 which is provided with a plurality of fuel supply holes 113 according to one embodiment of the present disclosure.

The fuel supply nozzle 11 of the present disclosure includes a front end 110 which is provided with the plurality of fuel supply holes 113, a rear end 111 which extends from the front end 110, and is formed with a threaded portion 114 on its outer surface, and an end plate 112 which is connected to the rear end 111, and is formed with a plurality of threaded holes 115.

Meanwhile, a fuel supply nozzle case 12 is provided with a plurality of fuel supply nozzle mounting holes 120, and the respective fuel supply nozzle mounting holes 120 is formed with a threaded surface 121 which is threadedly engaged with the threaded portion 114. The fuel supply nozzles 11 are assembled to the fuel supply nozzle case 12 to form a fuel supply nozzle unit 10.

Specifically, the fuel supply nozzle 11 consists of the front end 110 having a conical spray member and the plurality of fuel supply holes 113, and the rear end 111 having a coupling portion which is connected to a rear end of a combustor.

The fuel supply nozzle 11 is fed with a fuel from a fuel storage, and ejects a fuel/air mixture of high pressure into the combustor through the plurality of fuel supply holes 113.

Figure 3:
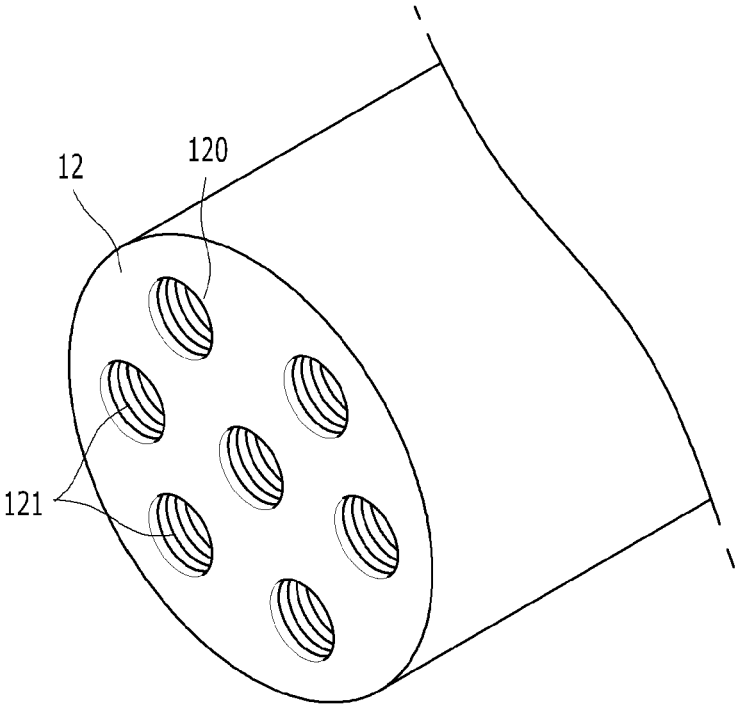
FIG. 3 is a perspective view illustrating a rear end of a combustor which is provided with a plurality of fuel supply nozzle mounting holes according to one embodiment of the present disclosure.

FIG. 3 is a perspective view illustrating the plurality of fuel supply nozzle mounting holes 120 which are provided in the rear end of the combustor according to one embodiment of the present disclosure.

The rear end of the combustor is provided with the plurality of fuel supply nozzle mounting holes 120, and the respective fuel supply nozzle mounting holes 120 has the threaded surface 121 formed on the inner peripheral surface thereof. The front end 110 of the respective fuel supply nozzles 11 is inserted from the rear end of the combustor, and then is threadedly engaged to the threaded surface 121 formed on the fuel supply nozzle mounting hole 120.

Figure 4:
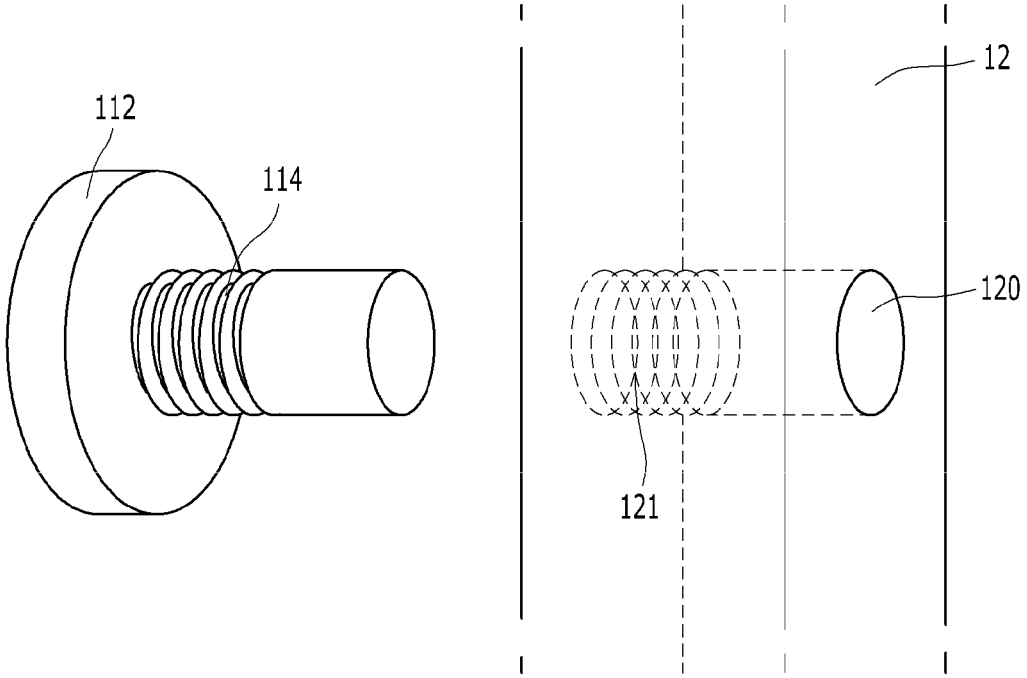
FIG. 4 is a perspective view illustrating the fuel supply nozzle which is fitted into the fuel supply nozzle mounting hole according to one embodiment of the present disclosure.

FIG. 4 shows the process of fitting the fuel supply nozzle 11 having the threaded portion 114 into the mounting hole 120 having the threaded surface 121.

More specifically, the conical front end 110 of the fuel supply nozzle 11 is first inserted into the fuel supply nozzle case 12, and then the threaded portion 114 formed on the rear end 111 of the fuel supply nozzle is directly engaged to the fuel supply case 12. Accordingly, it is possible to quickly and firmly engage the components by the engagement of the threaded portion 114.

The fuel supply nozzle unit 10 may be provided with a plurality of sealing members 13 which are provided on an interface between the outer surface of the rear end 111 of the fuel supply nozzle and the inner surface of the plurality of fuel supply nozzle mounting holes 120 formed on the fuel supply nozzle case 12.

Figure 5:
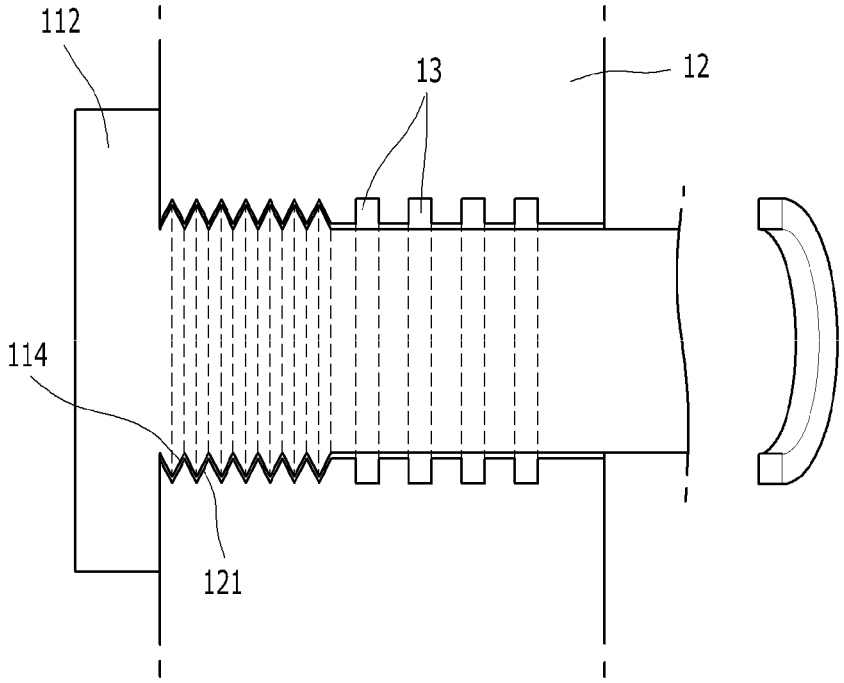
FIG. 5 is a side view illustrating the fuel supply nozzle having a plurality of sealing members according to one embodiment of the present disclosure.

FIG. 5 is a side view illustrating the fuel supply nozzle 11 having the plurality of sealing members 13 according to one embodiment of the present disclosure. The plurality of sealing members 13 may be provided as a sealing member of a donut shape, and the sealing member of the donut shape is generally positioned in front of the threaded portion 114 formed on the rear end 111 of the fuel supply nozzle. Alternatively, the sealing member may be positioned between the fuel supply nozzle 11 and the fuel supply nozzle case 12.

The sealing member of the donut shape may have a rectangular cross section, and this shape can provide the optimum sealing effect. However, the present disclosure is not limited to the rectangular cross section of the donut-shaped sealing member.

Figure 6:
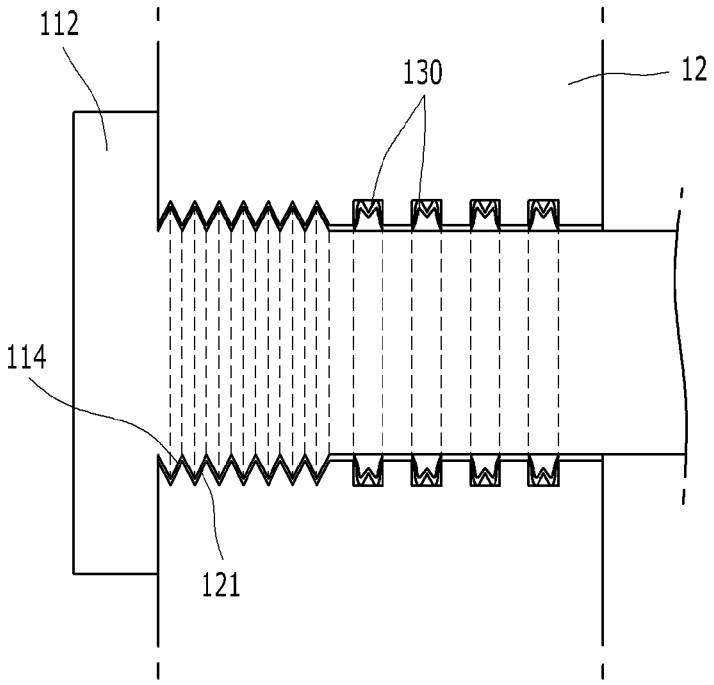
FIG. 6 is a cross-sectional view illustrating the fuel supply nozzle having the plurality of sealing members according to one embodiment of the present disclosure.

FIG. 6 is a cross-sectional view illustrating the fuel supply nozzle 11 having the plurality of sealing members 13 according to one embodiment of the present disclosure.

Figure 7:
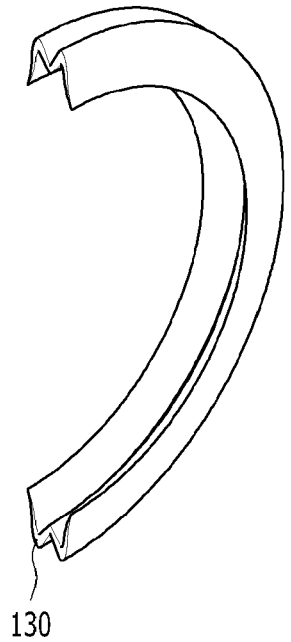
FIG. 7 is a cross-sectional view of an annular metal spring according to one embodiment of the present disclosure.
Figure 8:
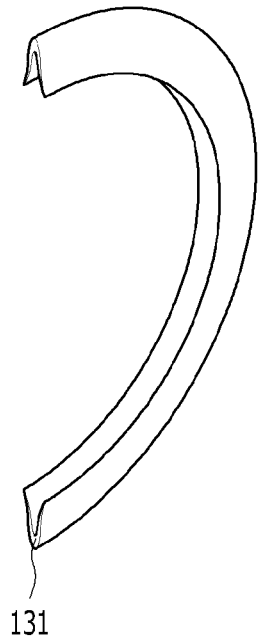
FIG. 8 is a cross-sectional view of an annular V-shaped sealing member according to one embodiment of the present disclosure.

The plurality of sealing members 13 may include a metal spring 130 having at least one contact surface. Specifically, the sealing member 13 may be provided by the M-shaped metal spring 130 having two contact surfaces, as illustrated in FIG. 7, or a V-shaped sealing member 131 having one contact surface, as illustrated in FIG. 8. The present disclosure is not limited to the number of contact surfaces described above, that is, two or less.

The position of the plurality of metal springs 130 is not limited to the location illustrated in FIG. 6. The metal springs may be provided on the interface between the fuel supply nozzle 11 and the fuel supply nozzle case 12.

Figure 9A:
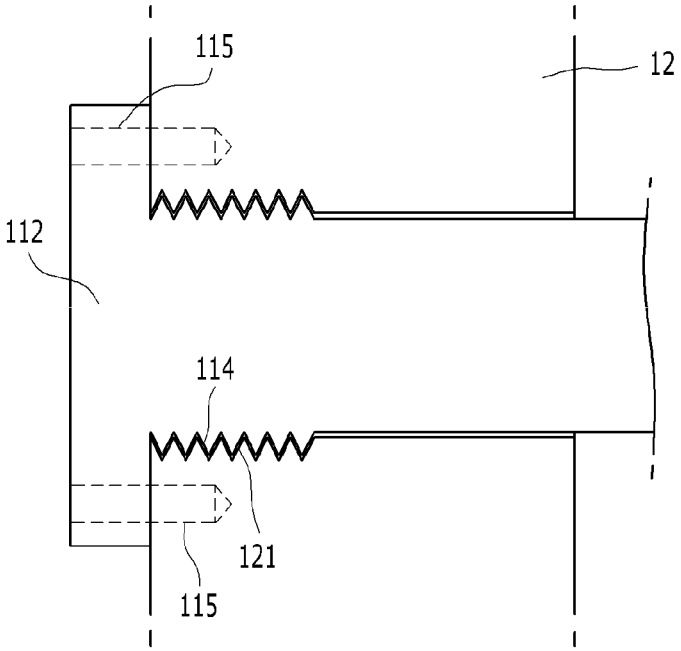
FIG. 9A is a cross-sectional view illustrating an end plate which is provided with a plurality of threaded holes according to one embodiment of the present disclosure.
Figure 9B:
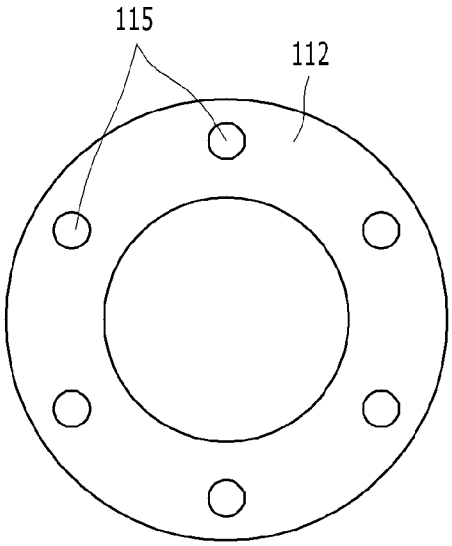
FIG. 9B is a front view illustrating an end plate which is provided with a plurality of threaded holes according to one embodiment of the present disclosure.

FIGS. 9A and 9B are a cross-sectional view and a front view illustrating the end plate 112 which is provided with the plurality of threaded holes 115 according to the embodiment of the present disclosure.

As illustrated in the drawings, the fuel supply nozzle 11 includes the end plate 112 connected to the rear end 111, and the end plate 112 provided at the distal end of the fuel supply nozzle 11 is formed to have a width larger than an inner diameter of the mounting hole 120.

The end plate 112 is configured to more firmly connect the fuel supply nozzle, as well as fixing the fuel supply nozzle by the screw structure. The end plate 112 is provided with a plurality of screw holes 115, so that the fuel supply nozzle can be fixed by additional screw engagement using the screw holes 115. The present disclosure is not limited to the number of screw engagement illustrated in FIG. 9, that is, 6.

Figure 10A:
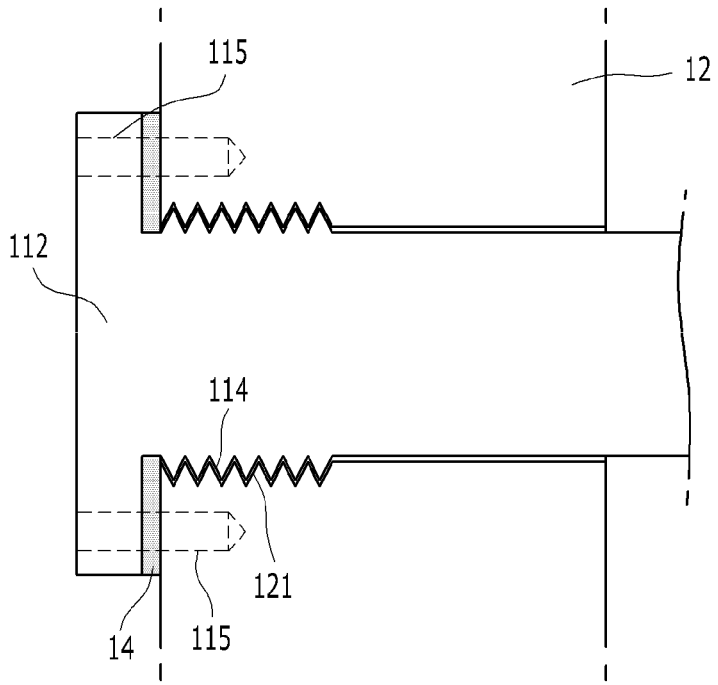
FIG. 10A is a cross-sectional view illustrating a finish gasket ring according to one embodiment of the present disclosure.
Figure 10B:
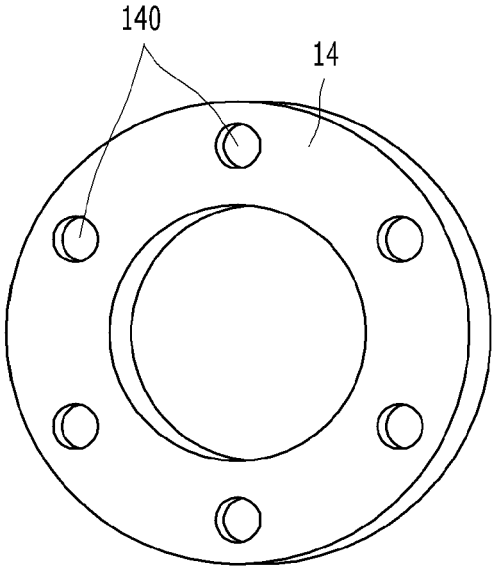
FIG. 10B is a front view illustrating a finish gasket ring according to one embodiment of the present disclosure.

Preferably, a finish gasket ring 14 may be provided on the interface between the end plate 112 and the fuel supply nozzle case 12 to further improve the sealing effect, and the finish gasket ring 14 is provided with a plurality of holes 140 corresponding to the plurality of screw holes 115 which are formed in the end plate 112 of the fuel supply nozzle 11. FIGS. 10A and 10B are a cross-sectional view and a front view illustrating the finish gasket ring 14 according to one embodiment of the present disclosure.

The finish gasket ring 14 is provided with the plurality of holes 140 corresponding to the position and number of the screw holes 115, and is interposed between the rear end of the fuel supply nozzle case 12 and the end plate 112 of the fuel supply nozzle 11 to firmly install and seal the fuel supply nozzle 11.

Meanwhile, a washer 15 provided with a plurality of washer holes 150 corresponding to the plurality of screw holes 115 formed in the end plate 112 of the fuel supply nozzle 11 may be interposed between the end plate 112 and the fuel supply nozzle case 12.

Figure 1B:
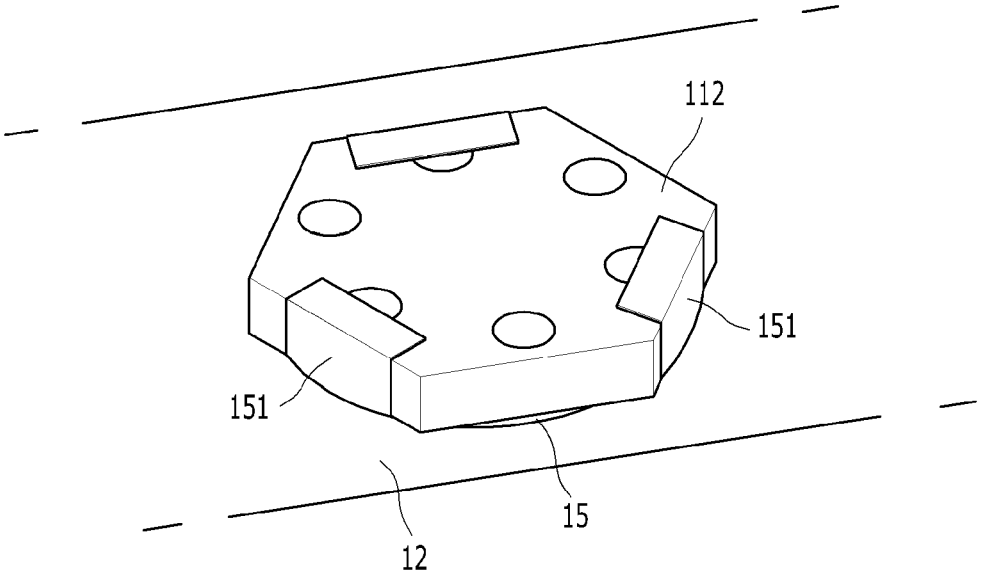
FIG. 1B is a perspective view illustrating a washer having a protrusion according to one embodiment of the present disclosure.

FIG. 1 is a view illustrating the washer 15 having a protrusion 151 according to one embodiment of the present disclosure.

The end plate and the washer 15 are not limited to a specific shape. If the contact area of the end plate 112 is not sufficient, the washer 15 is interposed between the end plate 112 and the fuel supply nozzle case 12 to increase a frictional force upon engagement and thus firmly fix the end plate.

In the case where the end plate 112 is provided with the screw holes 115, the washer 15 is provided with washer holes corresponding to the screw holes 115, similar to the finish gasket ring 14.

In addition, the washer 15 is characterized by having at least one protrusion 151. The protrusion 151 is bent to enclose the end plate 112, so as to prevent the end plate 112 from inadvertently rotating due to vibration or the like produced when the combustor operates which causes the fuel supply nozzle from to be unfastened. Therefore, the protrusion 151 more firmly fixes the end plate. Preferably, the side of the washer 15 is provided with at least one protrusion 151.

The protrusion 151 should have a length and wide enough to enclose the end plate 112 by bending the protrusion from the side of the washer 15 so as to fix the end plate 112.

In particular, the washer 15 can be used even if the end plate 112 is not provided with the screw hole 115. In this instance, the protrusion 151 has an excellent effect of preventing the rotation of the end plate 112.

Figure 11:
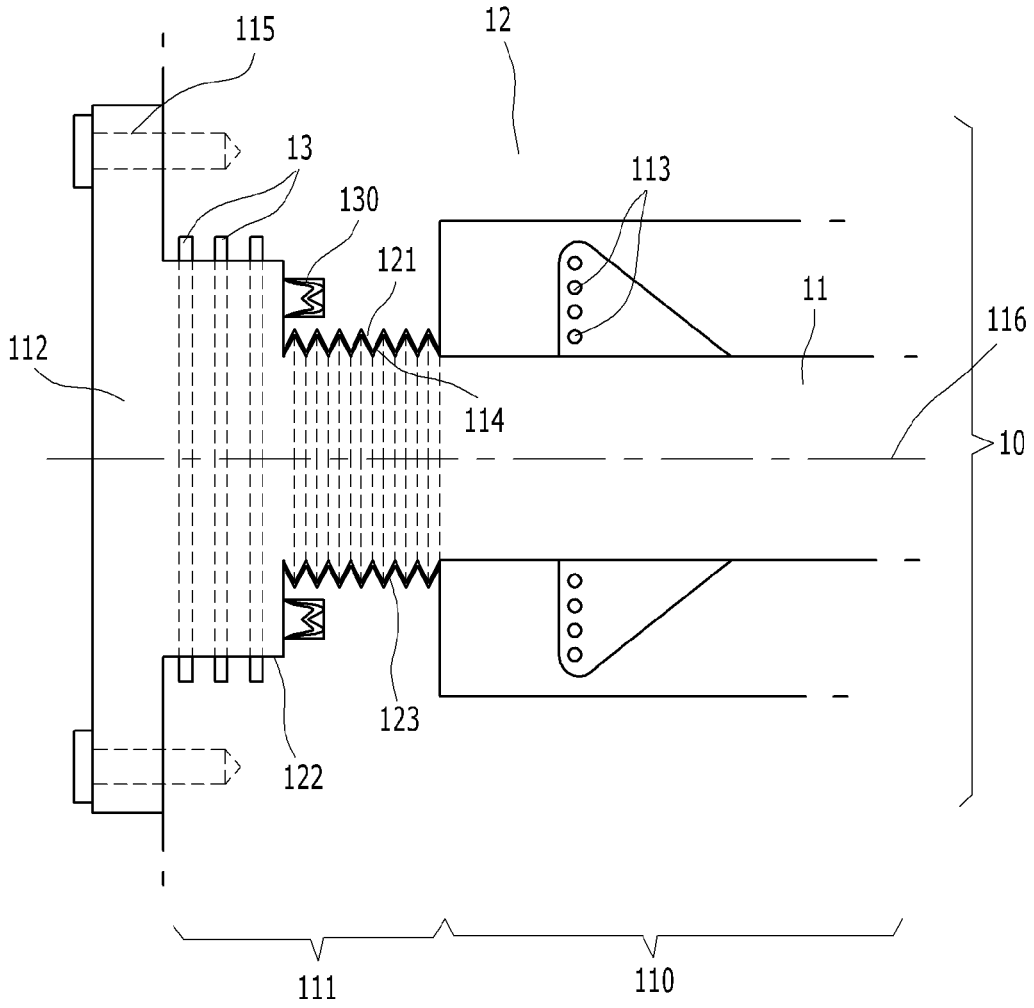
FIG. 11 is a cross-sectional view illustrating the rear end of the combustor, to which the fuel supply nozzle is fitted.

FIG. 11 is a cross-sectional view illustrating the rear end of the combustor, to which the fuel supply nozzle 11 according to one embodiment of the present disclosure is fitted.

FIG. 11 shows the state in which the fuel supply nozzle 11 is engaged to the fuel supply nozzle case 12. A stepped portion 122 is formed between the end plate 112 and the rear end 111 of the fuel supply nozzle formed with the threaded portion 114.

The stepped portion 122 is configured to improve the sealing effect and the fixing force, and the plurality of sealing members 13 are provided to the longitudinal side of the stepped portion 122. The annular metal spring 130 is inserted into the bottom surface of the stepped portion 123 as the sealing member.

Specifically, in addition to the sealing effect provided by the structure itself of the stepped portion 122, since the sealing members 13 and 130 are added by use of the lateral surface and the bottom surface of the stepped portion 122, the fuel supply nozzle unit 10 having the stepped portion 122 has the superior sealing effect and the fixing force, as compared to the configuration of the screw fastening only.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

EXPLANATION OF REFERENCE NUMERALS

10: Fuel Supply Nozzle Unit
11: Fuel Supply Nozzle
12: Fuel Supply Nozzle Case
13: Sealing Member
14: Finish Gasket Ring
15: Washer
110: Front End of Fuel Supply Nozzle
111: Rear End of Fuel Supply Nozzle
112: End Plate
113: Fuel Supply Hole
114: Threaded Portion
115: Screw Hole
116: Axis of Fuel Supply Nozzle
120: Fuel Supply Nozzle Mounting Hole
121: Threaded Surface
122: Stepped Portion
130; Metal Spring
131: V-shaped Sealing Member
140: Hole
150: Washer Hole
151: Protrusion

What is claimed is:

1. A fuel supply nozzle unit, comprising:

a fuel supply nozzle case that includes a plurality of threaded surfaces respectively formed inside each of a plurality of nozzle mounting holes formed in an inlet end of the fuel supply nozzle case;

a plurality of fuel supply nozzles respectively engaged with the plurality of nozzle mounting holes, each fuel supply nozzle including a front end that is cylindrical, a rear end that is cylindrical and extends from the front end, and an end plate coupled to the rear end, wherein the front end includes a distal end having a conical shape tapered toward the distal end and a plurality of fuel supply holes formed in a tapered surface of the distal end, and the rear end includes a threaded portion for engaging with one of the plurality of threaded surfaces;

a washer disposed at an interface between the inlet end of the fuel supply nozzle case and the respective end plates of the plurality of fuel supply nozzles; and a plurality of sealing members disposed at an interface between an outer surface of the rear end of each fuel supply nozzle and an inner surface of the nozzle mounting hole formed in the fuel supply nozzle case, wherein each fuel supply nozzle of the plurality of fuel supply nozzles further comprises a stepped portion having a cylindrical shape that has a first end integrally formed with the end plate and a second end integrally formed with the threaded portion of the rear end, wherein the fuel supply nozzle case further comprises a stepped recess that is configured to receive the stepped portion of each fuel supply nozzle, wherein the plurality of sealing members include a plurality of annular seals arranged along a longitudinal side of the stepped portion and an annular metal spring inserted between the stepped recess and a bottom surface of the stepped portion.

2. The fuel supply nozzle unit according to claim 1, wherein the end plate of each fuel supply nozzle includes a plurality of screw holes arranged in a circle, and the washer includes a plurality of washer holes corresponding to the plurality of screw holes.

3. The fuel supply nozzle unit according to claim 2, wherein the cylindrical shape of the stepped portion has an outer diameter that is less than a diameter of the end plate and is arranged inside the circle formed by the plurality of screw holes, and the threaded portion of the rear end of each fuel supply nozzle has a diameter less than the outer diameter of the cylindrical shape.

4. The fuel supply nozzle unit according to claim 3, wherein the stepped recess of the fuel supply nozzle case communicates with the threaded surface of each nozzle mounting hole of the plurality of nozzle mounting holes.

5. The fuel supply nozzle unit according to claim 1, wherein the threaded surface of each nozzle mounting hole of the plurality of nozzle mounting holes extends a predetermined distance from the inlet end of the fuel supply nozzle case.

6. The fuel supply nozzle unit according to claim 1, wherein the washer includes an outer periphery and a plurality of protrusions extending from the outer periphery, each protrusion including a distal end that is bent such that an outer peripheral surface and an upper surface of the end plate are enclosed by the distal ends of the plurality of protrusions.

7. The fuel supply nozzle unit according to claim 1, wherein the plurality of fuel supply holes are formed in the cylindrical surface of each fuel supply nozzle.

* * * * *